US008371283B2

(12) United States Patent
Grace et al.

(10) Patent No.: US 8,371,283 B2
(45) Date of Patent: Feb. 12, 2013

(54) CABLE GUARD AND GUIDES FOR ARCHERY BOWS

(75) Inventors: Nathaniel E. Grace, Port Huron, MI (US); Louis Grace, Jr., North Street, MI (US); Kyle B. Stokes, Annville, PA (US)

(73) Assignee: Grace Engineering Corp., Memphis, MI (US)

( * ) Notice: Subject to any disclaimer, the term of this patent is extended or adjusted under 35 U.S.C. 154(b) by 734 days.

(21) Appl. No.: 12/564,508

(22) Filed: Sep. 22, 2009

(65) Prior Publication Data

US 2010/0083943 A1 Apr. 8, 2010

Related U.S. Application Data

(60) Provisional application No. 61/102,472, filed on Oct. 3, 2008.

(51) Int. Cl.
*F41B 5/10* (2006.01)
*F41B 5/14* (2006.01)

(52) U.S. Cl. ..... 124/88; 124/25.6; 124/86; 124/90

(58) Field of Classification Search ..... 124/25.6, 124/86, 88, 90

See application file for complete search history.

(56) References Cited

U.S. PATENT DOCUMENTS 4,452,222 A * 6/1984 Quartino et al. ..... 124/23.1
4,542,591 A * 9/1985 Montgomery ..... 33/265
4,596,228 A * 6/1986 Smith ..... 124/25.6
4,714,070 A * 12/1987 Shelton ..... 124/86
4,886,038 A * 12/1989 Betters ..... 124/25.6
4,903,678 A * 2/1990 Walker ..... 124/90
4,917,070 A * 4/1990 Townsend ..... 124/23.1
4,919,108 A * 4/1990 Larson ..... 124/88
5,002,035 A * 3/1991 Brooks ..... 124/23.1
5,161,514 A * 11/1992 Cary ..... 124/24.1
5,392,757 A * 2/1995 Head et al. ..... 124/86
5,415,149 A * 5/1995 Derus et al. ..... 124/23.1
5,531,211 A * 7/1996 Wilfong, Jr. ..... 124/86
5,553,597 A * 9/1996 Sparks ..... 124/44.5
5,553,600 A * 9/1996 Miller ..... 124/86
5,651,355 A * 7/1997 Gallops, Jr. ..... 124/25.6
5,718,213 A * 2/1998 Gallops et al. ..... 124/25.6
5,722,385 A * 3/1998 Bunk ..... 124/86
5,791,324 A * 8/1998 Johnson ..... 124/25.6
5,983,880 A * 11/1999 Saunders ..... 124/25.6
6,176,231 B1 * 1/2001 Smith ..... 124/25.6
6,425,385 B1 7/2002 Gallops, Jr.
6,629,522 B2 * 10/2003 Andrews ..... 124/25.6
6,655,371 B2 12/2003 Gallops, Jr.
6,681,754 B1 * 1/2004 Angeloni ..... 124/44.5
6,722,354 B1 * 4/2004 Land ..... 124/25.6
6,904,900 B2 6/2005 Gallops, Jr.
8,020,544 B2 * 9/2011 McPherson et al. ..... 124/25.6
2010/0089375 A1 * 4/2010 McPherson et al. ..... 124/25.6

(Continued)

*Primary Examiner* — Gene Kim
*Assistant Examiner* — Alexander Niconovich
(74) *Attorney, Agent, or Firm* — Warner Norcross & Judd LLP

(57) ABSTRACT

An archery bow includes a cable guard and an optional cable guide that holds a cable of the bow away from a plane in which a bowstring of the bow moves. The cable guard can define a bore, through which the cable is positioned, extending generally parallel to the bowstring when the bowstring is in an undrawn state. The cable guard bore can include a rounded opening to minimize abrasion to the cable. The cable guide can include a ceramic element having a rounded surface to minimize abrasion to the cable. The ceramic element can be included in an immovable or stationary cable guide, as well as an alternative cable guide including moving components, to engage and hold the cable away from the bowstring, while minimizing abrasion and/or friction on the cable.

20 Claims, 8 Drawing Sheets

U.S. PATENT DOCUMENTS

2010/0101549 A1* 4/2010 Grace et al. ..... 124/25.6
2010/0132685 A1* 6/2010 De Sousa ..... 124/88
2010/0263650 A1* 10/2010 Dahl et al. ..... 124/25.6
2010/0282226 A1* 11/2010 Marzullo ..... 124/25.6
2011/0011385 A1* 1/2011 Grace et al. ..... 124/25.6
2011/0073090 A1* 3/2011 McPherson ..... 124/25.6
2011/0192385 A1* 8/2011 Clark ..... 124/25.6
2012/0042861 A1* 2/2012 Anselmo ..... 124/25.6

* cited by examiner

CABLE GUARD AND GUIDES FOR ARCHERY BOWS

This application claims the benefit of U.S. Provisional Application 61/102,472, filed Oct. 3, 2008, which is hereby incorporated by reference.

BACKGROUND OF THE INVENTION

The present invention relates to archery bows, and more particularly to a cable guard and cable guide for archery bows.

Conventional compound archery bows include a bowstring and a set of cables, usually an up cable and a down cable, to transfer energy from the limbs and cams or pulleys (which are both referred to generally as "cams" herein) of the bow to the bowstring, and thus an arrow shot from the bow. The cables and bowstring are strung from a cam on one limb to a cam on another limb. Typically, the bowstring is positioned very close to the cables due to the configuration of the cams. To avoid interference between the vanes of an arrow shot from the bowstring and the cables, most compound bows include cable guards.

Generally, cable guards provide adequate clearance for arrow vanes or fletchings in the lateral spacing between cables and the plane in which the bowstring travels. The clearance can be achieved by offsetting the cables from the path or plane of the bowstring with the cable guard. Most cable guards include one or more cable guides that work with the cable guard to distance the cables from the cable guard, as well as from one another.

Many cable guards include a bar that extends from the riser of a bow. A cable guide is usually slidably mounted on the bar. The cable guide typically defines two open ended slots, one for receiving an up cable of the bow, the other for slidably receiving a down cable of the bow. Although this construction provides effective cable clearance, over time, the cable guide can wear, leading to abrasion or other damage to the cables. Moreover, the sliding movement of the cable guide on the cable guard can also cause wear to both structures, and can undesirably complicate the assembly.

More recent cable guard constructions have implemented pulleys. For example, U.S. Pat. No. 6,722,354 to Land discloses a cable guard including pulleys that serve as the cable guides. Although this design provides effective cable guidance, it too includes moving parts that must be monitored for wear and surfaces that can cause premature wear or abrasion on the cables.

While conventional cable guards and guides provide decent guidance for cables, there remains room for improvement to provide an archery bow with simple cable guards and guides that perform in an efficient and reliable manner.

SUMMARY OF THE INVENTION

An archery bow is provided including a cable guard and an optional cable guide that holds a cable of the bow away from a plane in which a bowstring of the bow moves.

In one embodiment, the cable guard can define a bore, through which the cable is positioned, extending generally parallel to the bowstring when the bowstring is in an undrawn state.

In another embodiment, the cable guard bore can include a rounded or radiused opening or inner surface to minimize abrasion to the cable as the cable moves when the bow is drawn or shot.

In yet another embodiment, the cable guide can include a low friction element constructed from materials, such as a ceramics, composites or polymers. The low friction element can be include a rounded or radiused surface, such as an edge that engages the cable. Optionally, the low friction element can be included in a stationary cable guide, having no moving components, to engage and hold the cable away from the bowstring, while minimizing abrasion and/or friction on the cable and while remaining in substantially the same position relative to a riser of the bow.

In still another embodiment, the cable guard can define at least one cable guard bore. The cable guard bore can be substantially perpendicular to a longitudinal axis of the cable guard and parallel to the bowstring in an un-drawn state. The cable guard bore can also be configured to at least partially receive at least one cable guide therein. The cable guide can be in the form of an insert, or other construction, and can be configured to further receive and guide at least one cable therein.

In a further embodiment, the cable guide can include a moveable component, such as a cable guide that slides or rotates relative to the cable guard, or a cable guide including a rotatable pulley mounted to the cable guard. The low friction element can be positioned between the cable and the moveable component to reduce abrasion to the cable.

The archery bow provided herein provides cable guards and optional cable guides that efficiently guide one or more cables of the bow. Where included, the low friction element can reduce wear on the cables and therefore increase cable life, as well as improve cable movement and performance.

These and other objects, advantages, and features of the invention will be more fully understood and appreciated by reference to the description of the current embodiment and the drawings.

DETAILED DESCRIPTION OF THE CURRENT EMBODIMENT

I. Construction and Use

Figure 1:
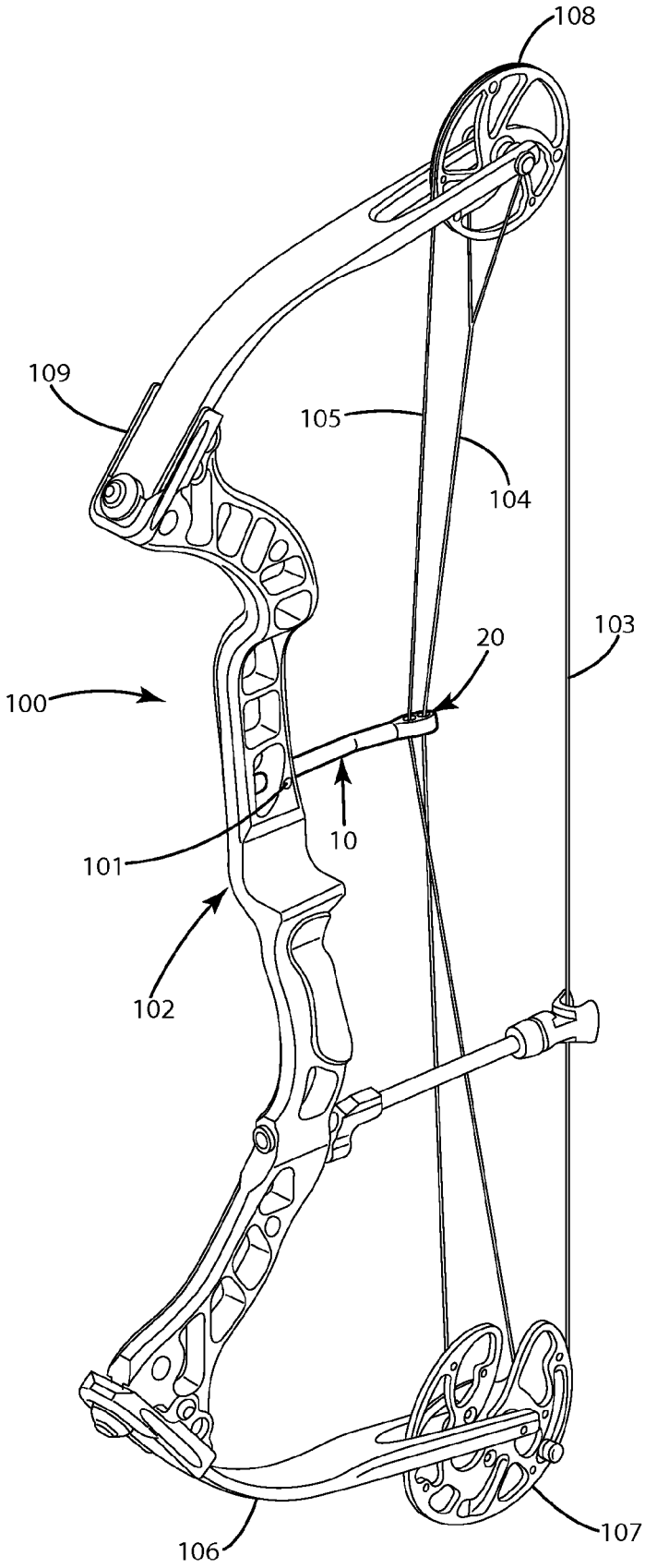
FIG. 1 is a perspective view of a current embodiment of a compound archery bow including a cable guard and a cable guide.
Figure 2:
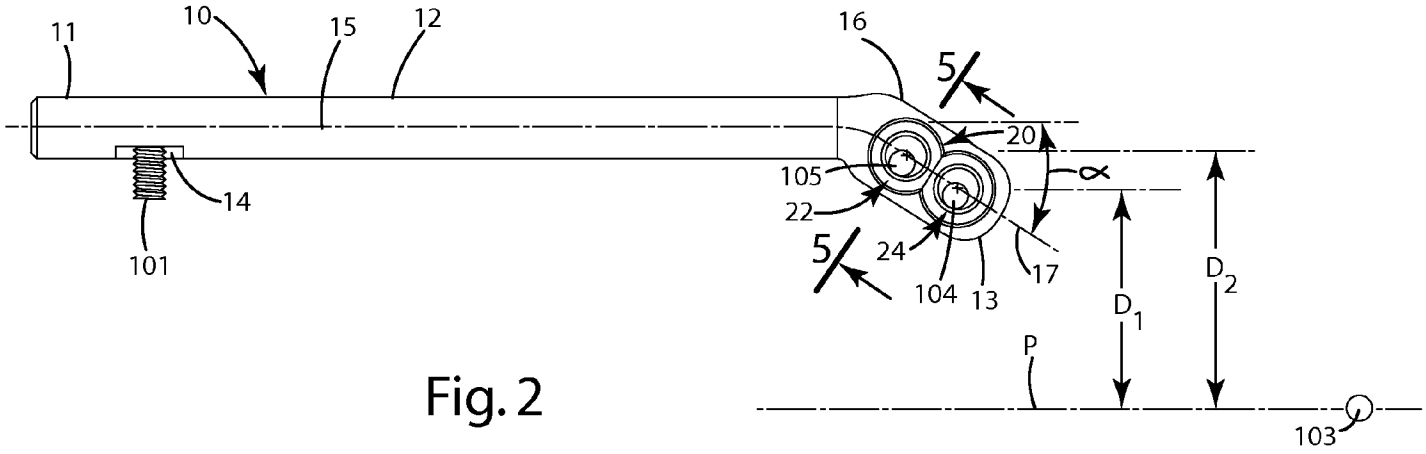
FIG. 2 is a top view of the cable guard and guides.

FIGS. 1-5 illustrate a current embodiment of the archery bow 100 including a cable guard 10 and a cable guide 20. In general, the archery bow 100 includes an upper limb 103 and a lower limb 105 attached to or otherwise joined with a riser 102. A set of cams 107 and 108, which can either be conventional cams and/or conventional pulleys, are joined with the respective upper 103 and lower 105 limbs. A bowstring 103 is strung around at least a portion of one or more of the cams 107 and 108. As shown in FIG. 2, the bowstring 103 moves in a bowstring plane P from an undrawn state to a drawn state and vice versa. The archery bow also includes one or more cables 104, 105, which can be upward moving and/or downward moving cables, depending on the bow type. The bowstring 103 and cable 105 can be joined with the cable 105 generally being a continuation of the bowstring 103. Although shown as a single cam compound archery bow, the current embodiment is well suited for dual cam systems, cam and a half systems, and other systems including a bow string and a cable. Further, although illustrated as a compound bow, the current embodiment can be used in connection with a cross bow, or any bow including a bowstring and a cable.

Figure 4:
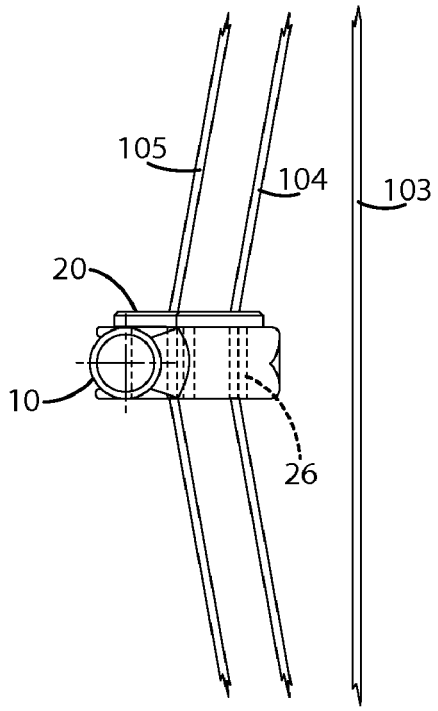
FIG. 4 is an end view of the cable guard and cable guides illustrating associated cables and a bow string.

The cables, as shown in FIGS. 2 and 4, are generally held distances D1 and/or D2, which can be equal or different, away from the bowstring plane P to provide for adequate arrow and fletching clearance when the bowstring moves, that is, when the bow is drawn and/or shot. In general, the cable guide 20 engages the cables 104 and 105 so that the cables move outside the plane P of bowstring travel. The cables 104 and 105 pass through the guide 20, and in particular, the bores defined by the cable guide 20. The cable 104 can pass through the bore in the cable guide nearest the plane P of bowstring travel. The other cable 105, which again optionally can be a continuation of the bowstring 103, can pass through the other bore in the cable guide located farthest from the plane P of bow string travel. Optionally, the cable guide 20 can be positioned a fixed distance from the riser 102 so that the cables 104 and 105 move generally through fixed stationary locations as the bowstring 103 moves in plane P.

Referring to FIGS. 1-5, the archery bow cable guard 10 and cable guide 20 will now be described in more detail. The cable guard 10 generally includes a cylindrical rod 12 extending from the riser 102 and a guide portion 16, where the optional guide element 20 can be mounted. The cross section of the rod, however, can be a variety of geometric shapes including circular, triangular, rectangular, hexagonal, diagonal and other shapes as desired. The rod itself and the remainder of the cable guard can be formed from a rigid material, for example, a metal or composite, optionally aluminum, magnesium or other materials. Further optionally, the cable guard and its components, for example the rod, can be formed from titanium. In some cases, because of its strength, an optional titanium cable guard can have a central region, located about midway between the riser and the guide end, that is of a reduced dimension compared to the ends of the cable guard. For example, the central region can have a cross section that is about 75% and optionally about 50% the area of cross sections of the ends. This reduced dimension can enable the titanium cable guard to flex in a predetermined manner, possibly reducing the potential for one of more of the cams to lean out of vertical alignment.

As yet another option, the materials used to construct the cable guard can be selected and/or combined in a way so that the resulting cable guard flexes slightly toward the plane in which the bowstring travels. With this flexing cable guard construction, the potential for one or more of the cams to lean out of vertical alignment can be reduced if desired.

The cable guard 10 can be joined with the riser 102 in a fixed, generally immovable configuration relative to the riser via a set screw 101 engaging a bore or flattened recess 14 defined by the rod 12. Other mechanisms can be used to secure the cable guard 10 to the bow 102. For example, the cable guard 10 can be threaded on its riser end 11, and can be threaded into a corresponding threaded hole defined by the riser 102. Other optional fasteners, such as clamping devices, can be included on the riser, and can hold the cable guard 10 fixedly joined with the riser.

In the embodiment illustrated in FIGS. 1-11, the cable guard 10 remains in a generally fixed and immovable configuration relative to the riser 102. Given the joining of the cable guides 20 to the cable guard 10, and their immovable relationship relative to one another in the current embodiment of these figures, the cable guard 10, cable guard bore 26 and the insert 50, along with all of the inserts components, as well as the cable guides 20, remain generally stationary and immovable in relation to the riser 102, even when the bowstring is drawn to a drawn state and/or when the bowstring is released to shoot an arrow from the bow. Generally, the components of the cable guard and cable guide of the current embodiment in FIGS. 1-11 can be considered immovable and held in a fixed relation to one another and to the riser when the bowstring moves.

Further, in the current embodiment, the cable guide 20 can be considered to be held at a fixed distance from the riser throughout the stroke of the bowstring. It is noted that while there might be a slight flexure of the cable guard when the cables are under extreme tension along the draw stroke, the cable guides are still considered to be held at a fixed distance from the riser 102. Of course, as described below, the cable guard and cable guide can be incorporated into alternative constructions that include moving parts.

The cable guard rod 12 is joined at the riser end 11 with the riser 102. Opposite the riser end 11 is a cable end 13. The cable end 13 of a cable guard 10 can include a guide portion 16 that can be generally angled relative to the longitudinal axis 15 of the rod 12. The guide portion 16 can be at an angle $\alpha$ that is optionally about 0 to about 90 degrees, further optionally about 50 degrees, and even further optionally about 30 degrees. With this offset angle $\alpha$, the guide portion 16 can be positioned to locate the cables 104 and 105 a suitable distance D1 and/or D2 from the plane P in which the bowstring 103 travels. More particularly, the cable guides 20 can lie on a secondary axis 17 that is offset at angle $\alpha$ relative to the longitudinal axis 15 of the bar rod 12. Again, the precise angle $\alpha$ can be selected to precisely position the cables relative to the bowstring travel plane P, and accordingly, to provide clearance for vanes of an arrow shot from the bow 100.

Figure 5:
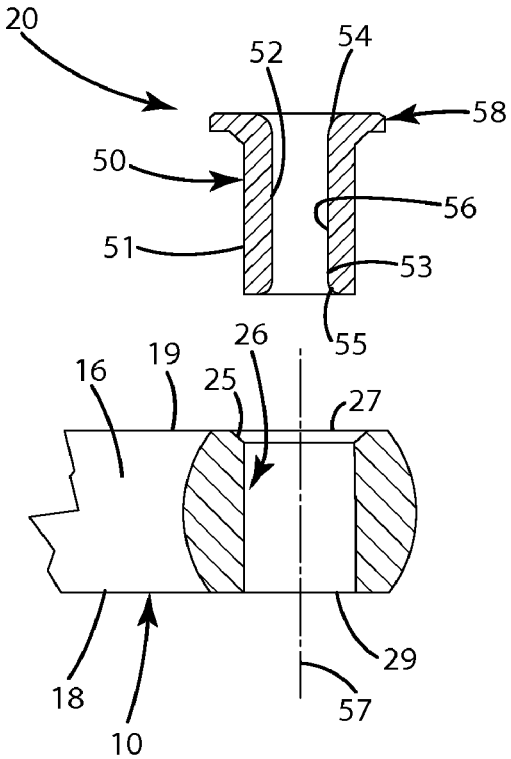
FIG. 5 is an exploded cross sectional view of the cable guard and cable guides taken along line 5-5 of FIG. 2.

As shown in FIGS. 2-5, the guide portion 16 of a cable guard 10 generally includes two cable guides 22 and 24. The guide portion 16 is generally flattened and defines cable guard bores 26. Generally the cable guard bore 26 in which the respective cable guides 20 is positioned parallel to the bowstring 103 when the bowstring 103 is in an undrawn state as shown in FIGS. 2 and 4. With reference to FIG. 5, the cable guard bores 26 can include a first opening 27 and a second opening 29 on the upper 19 and lower 18 surfaces of the guide portion 16 of the cable guard 10. The bores 26 can be sized to accommodate the cable guides 20. The cable guard bore 26 also can include an chamfered opening 25 to better mate with the shoulders or flanges 58 of the cable guides 20.

The cable guides 20 can be in the form of inserts 50. As shown in FIGS. 4 and 5, the inserts can include an exterior surface 51 and an interior surface 53. The interior or inner surface 53 can be divided into a first radiused or rounded surface 54, which can be adjacent the first opening 27 of the cable guard when the insert is inserted into the cable guard bore, and a second radiused or rounded surface 55 which can be adjacent the second opening 29 of the cable guard when the insert is inserted into the cable guard bore 26. Optionally, the first rounded surface 54 and/or the second rounded surface 55 can include single radii or compound radii or any curvilinear structure that is configured to minimize abrasion and/or wear on the respective cables placed through the insert. Depending on the cable with which the insert 50 is used, one or both of the rounded surfaces 54 and 55 can be eliminated—that is, the surface can be generally unrounded if desired.

The inner surface 53 can also include a middle region 56 located between the first rounded surface 54 and the second rounded surface 55, or generally between the openings 27 and 29. This middle region 56 can be flat as shown, or optionally, it can be rounded or curved. If desired, the first rounded surface 54 can transition smoothly into the middle region 55, which can transition smoothly into the second rounded surface 55. In this configuration the combined rounded surfaces and middle region can form a curvilinear contour from top to bottom of the guard insert. In this manner, these features can generally form a bulge that extends inwardly toward the axis 57 of the insert 50.

Figure 3:
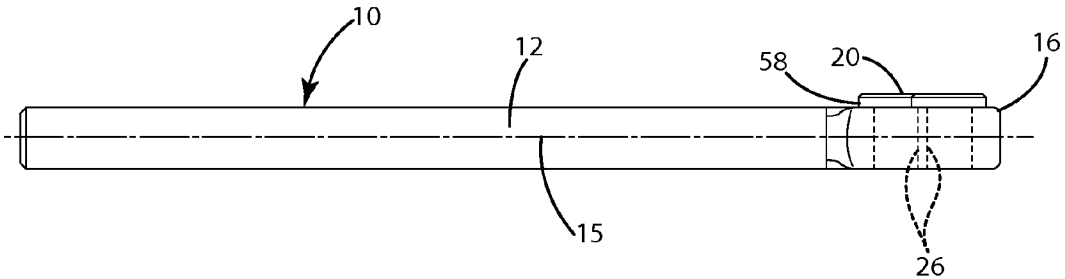
FIG. 3 is a side view of the cable guard and guides.

As also shown in FIG. 5, the insert 50 can include a shoulder or flange 58. When the insert is inserted into the cable guard, this shoulder can include a portion that extends slightly into the chamfered region 25, and another portion that abuts the upper surface 19 of the guide portion 16 of the cable guard 10. As shown in FIGS. 2-4, the shoulders 58 generally are positioned on the upper surface 19 of the cable guard 10. However, the cable guides 20, and more particularly the inserts 50 can be inserted with their shoulders or flanges on the upper 19 or lower 18 surfaces of the cable guard 10.

As shown in FIGS. 2-3 and 5, the flange 58 surrounding the insert 50 can be sized to restrict the depth of insertion of the inserts 50 into the cable guide bore 26. Of course, as desired, that flange can be completely removed in some applications where sliding of the insert 50 is not of concern. Further, the shape of the outer edge of the flange or shoulder 58 can be a function of the spacing of the two or more bores 26 relative to one another in the cable guard 10. Although shown as circular, the flange can be elliptical, a rounded polygon, or other geometries. Optionally, the shoulders of adjacent cable guides 22 and 24 can include interlocking edges that prevent rotation of the cable guides 22 and 24 relative to one another and/or to the cable guard 10.

The flange or shoulder 58 of the insert 50, and in general the cable guide 20, can be positioned adjacent the edge of the openings 27 or 29 of the cable guard bore 26 to prevent the respective cable from engaging the cable guard. The different cable guides 22 and 24 can also be alternately inserted, with one from the top, and one from the bottom, to correspond to the direction in which the cables 104 and 105 travel. Generally, the direction of the travel of the cables and/or curvature of the radii on the rounded surfaces 54 and 55 on the ingress and egress edges of the insert 50, can dictate the direction in which the cable guide inserts are inserted.

The insert 50 can be inserted into the cable guard bore 26 with a very close tolerance between the outer surface 51 and the bore 26. Optionally, the insert can be slightly friction-fit within the cable guide bore as desired. Further optionally, the insert 50 can be secured to the cable guard 10 by including an adhesive within the cable guard bore 26 before insertion of the insert 50. The adhesive can adhere the insert directly to the cable guard bore 26 in a fixed and immovable position. A variety of other mechanisms can be used to fixedly and immovably join the insert 50, and in general the guides 20, to the cable guard 10. For example, a set screw can be included in the cable guard to gently engage the insert and hold it in place. Alternatively, the exterior surface 51 of the insert 50 can be threaded, and can thread into corresponding threads in the cable guard bore 26.

The cable guide 20, and in particular, the insert 50, can include an inside diameter that is sized to readily allow the cables 104 and 105 to slide therewithin. The inside diameter of the insert 50 also can be sized so that the connecting loops of the cables (not shown) can be easily positioned through the insert, and further connected to the cams or other portions of the bow.

As shown in FIG. 2, the cable guides 20 and more generally the cable guard bores 26 can be configured so that they completely circumferentiate the respective cables 104 and 105. Of course, where a different construction of the cable guard and the cable guides is selected, these components may only partially circumferentiate and/or surround the respective cables. As an example, the cable guards can define generally vertical slots that surround only a portion of the cables. Likewise, if included, the cable guides can include corresponding slots aligned with the slots in the cable guards. In this construction, the cables can be removed somewhat easily from these elements, simply by lifting the cables out through the slots. Further, in other alternative embodiments, for example where the cable guard is coated with a low friction element as described below, the cable guard is simply placed adjacent the respective cable, without surrounding it.

The cable guides 20, and their components, such as the inserts 50 can be constructed from a low friction material. Suitable low friction material can include a ceramic material, and optionally, a glazed ceramic material, such as a glazed porcelain. Other suitable low friction materials include, but are not limited to, polymers, such as polyethylene, polytetrafluoroethylene, or polyvinylchloride, low friction composites, polished metals, or other materials that provide a sufficiently low coefficient of friction (static and/or kinetic) and suitable resistance to wear when engaged with a cable. Where a cable guide is said to include a ceramic element herein, the cable guide can be constructed entirely from a ceramic material, such as a glazed ceramic material, a porcelain material, and/or a glazed porcelain material, or can simply include a component and/or surface that is constructed from and/or coated with at least one of these materials.

If a ceramic material is used to construct the cable guide 20 and its components, such as in insert 50, then the brittle nature of the ceramic material and the resultant insert can dictate a slip fit between the outer surface 51 of the insert 50 in the internal surface of the cable guard bore 26. Again, in such a slip fit construction, the inserts 50 can be bonded to the respective bores 26 with a suitable adhesive, glue, cement, or other material or mechanism. If the low friction material, on the other hand, is less brittle and/or more pliable than ceramic, for example a high density polypropylene, then the insert 50 can be press-fit into the bore 26 of the cable guard 10. With this press-fit construction, the cable guides 20 can be generally joined with the cable guard 10 without further bonding with materials such as adhesives, or other mechanisms.

II. Assembly

The archery bow 100 of the current embodiment can be assembled by joining the bowstring 103 and cables 104 and 105 with the respective cams in a variety of manners. In one, each of the two cables 104 and 105 include looped ends that are designed to attach to anchor posts on the cam 107. The loop ends of each of the cables and/or bowstring can be inserted through the respective bore of its respective guide 22, 24 before stringing the bow, and before attaching the cable guard 10 to the riser 102 of the bow 100. It is noted that generally upon drawing the bow 100, the cables 104 and 105 move in opposite directions. For example, the cable 105 moves upward, and the cable 104 moves downward. The upward cable 105 can be inserted into the guide bore distanced the farthest from the bowstring travel plane P. The downward travelling cable 104 can be positioned in the cable guide bore that is closest to the bowstring travel plane P as shown in FIGS. 2 and 4.

After initial stringing, the riser end of the cable guide 10 is inserted into a hole located in the riser 102 of the bow 100. This hole can be located above the handle, in the offset portion of the riser 102, adjacent the shelf of the riser. Of course, the cable guard 10 can be installed either above or below the shelf, and/or the handle of the riser. In general, the cable guard is positioned such that the cable guides 20 position the cables 104 and 105 to achieve the desired clearance from the bowstring plane P, and more generally, achieves the desired clearance of vanes on arrows being shot from the bow. With the cable guard so positioned, the guard can be secured via a set screw 101 or other fastener that engages the cable guard 10 and holds it in a fixed position relative to the riser 102. As desired, the cable guard 10 and cable guide 20 can be readjusted to ensure adequate placement of the cables and arrow vane clearance.

III. First Alternative Embodiment

Figure 6:
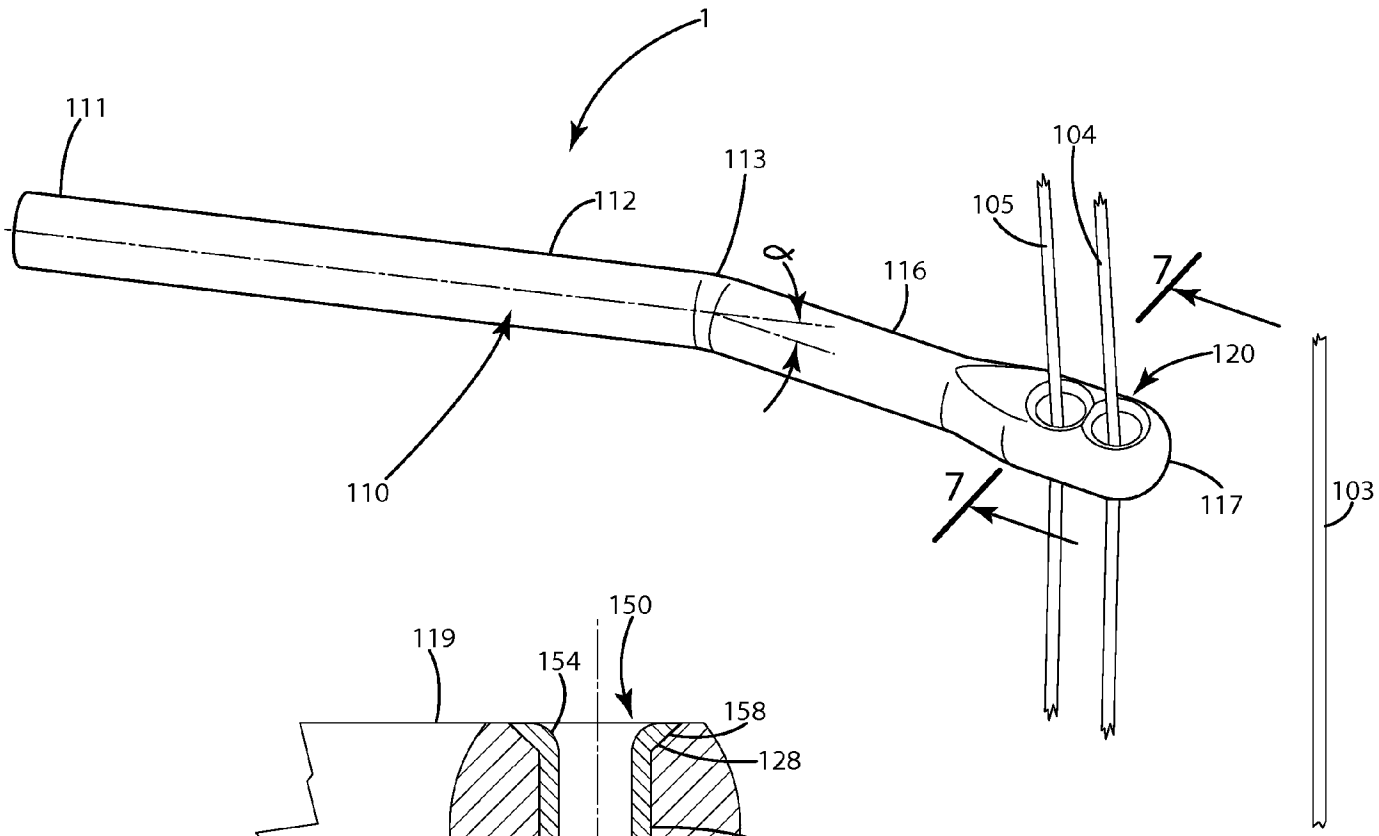
FIG. 6 is a perspective view of a first alternative embodiment of the cable guard and guides.
Figure 7:
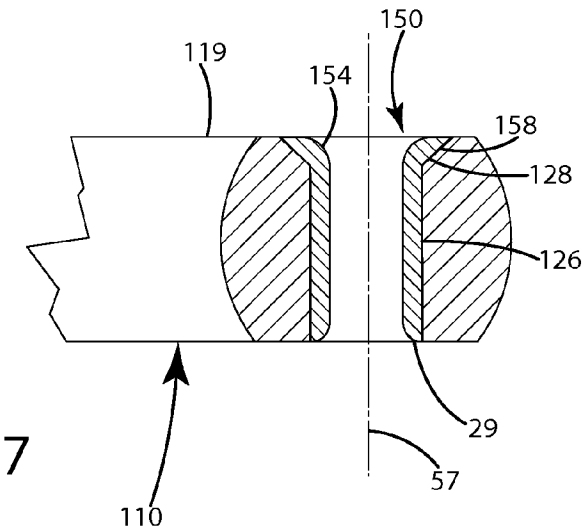
FIG. 7 is a cross sectional view of the first alternative embodiment of the cable guard and guides taken along line 7-7 of FIG. 6.

With reference to FIGS. 6 and 7, a first alternative embodiment of an archery bow including a cable guard and cable guide will now be described. In general, this first alternative embodiment is similar to the embodiment described above with a few exceptions. For example, the cable end 117 of the cable guard 110 is angled at a region 113 closer to the riser end 111 than that of the embodiment described above. The guide portion 116 can be angled relative to the remainder of the bar 112 at an angle $\alpha$, optionally between about 0 and about 90 degrees, further optionally about 5 and about 35 degrees, and even further optionally about 11 degrees. At these angles, the cable guard 110 can achieve a suitable location of the cables in relation to the bow string 103 and the plane in which the bow string 103 moves. This angle can also provide suitable clearance for the vanes of an arrow shot from the bowstring 103.

As shown in FIG. 7, this embodiment can also include a slightly different insert 150. For example, the insert 150 can include a chamfered shoulder 158, which is positioned adjacent the chamfered outer edge 128 of the cable guard bore 126. Further, the upper most portion of the insert 150 can be flush with or optionally can be located slightly below, the upper surface 119 of the cable guard 110. The insert 150 of this embodiment can include a rounded surface 154 adjacent the upper opening of the insert, and optionally, another rounded surface adjacent the lower opening of the insert. The insert itself can be constructed from any of the low friction materials explained above.

IV. Second Alternative Embodiment

Figure 8:
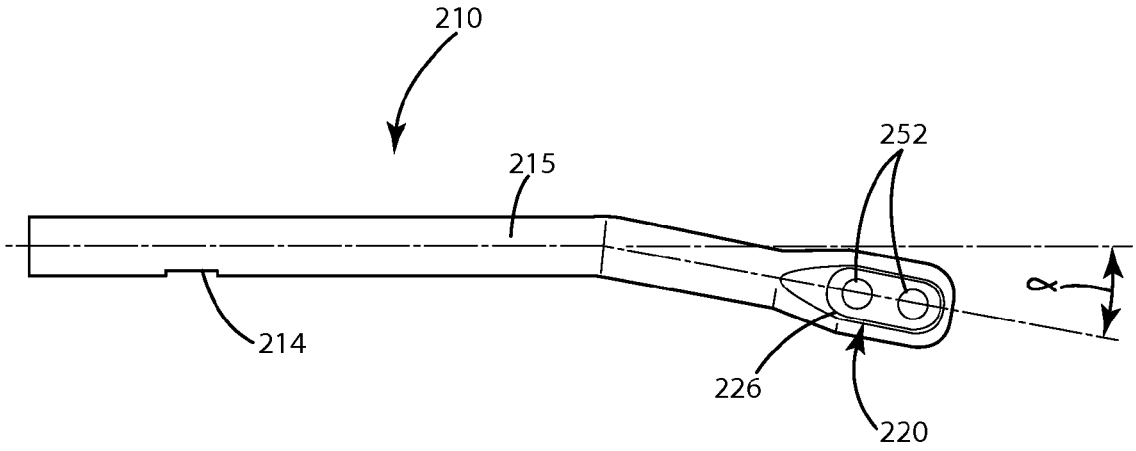
FIG. 8 is a top view of a second alternative embodiment of the cable guard and cable guide.
Figure 9:
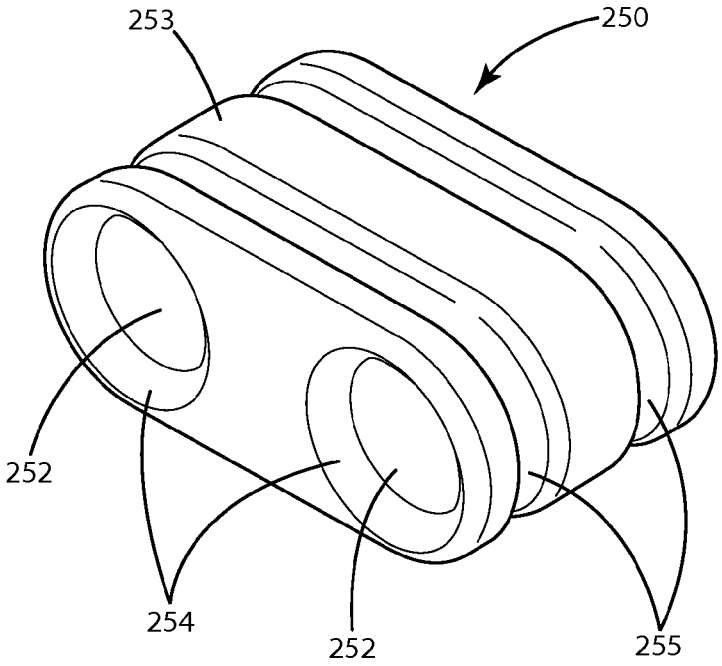
FIG. 9 is a perspective view of the cable guide of the second alternative embodiment.

Referring to FIGS. 8 and 9, a second alternative embodiment of an archery bow including a cable guard and cable guide will now be described. In general, the second alternative embodiment is similar to the embodiment described above with a few exceptions. For example, instead of defining separate cable guard bores, the cable guard 210 includes a generally oblong or elongated cable guard bore 226 in which a single piece cable guide 220 is inserted. As shown in FIG. 9, that cable guide 220 can be in the form of an oblong cable guide insert 250 which defines cable guide bores 252, which can be configured similar to any of the internal bores of the embodiments described above.

The cable guide insert 250 can generally be constructed from a single integral piece of low friction material, such as glazed ceramic, or any of the other low friction materials mentioned above. The respective ingresses and egresses of the bores 254, can have radii and/or be chamfered to minimize friction and stress on the cables, as described in connection with the embodiments above.

The outer surface 253 of the insert 250 of this embodiment can define at least one groove 255. A corresponding groove or grooves can also be provided in the cable guard bore 226 (not shown). Within these respective groove or grooves, O-rings can be seated. The O-rings optionally can serve to retain the insert 250 in the cable guard bore 226, and to attenuate or isolate vibrations induced in the cables, and noise resulting from the vibrations. Alternatively, the voids or grooves 255 can serve as a space for the application of an adhesive or other bonding agent or mechanism to retain the insert 250 in the cable guard bore 226 defined by the cable guard 10.

V. Third Alternative Embodiment

Figure 10:
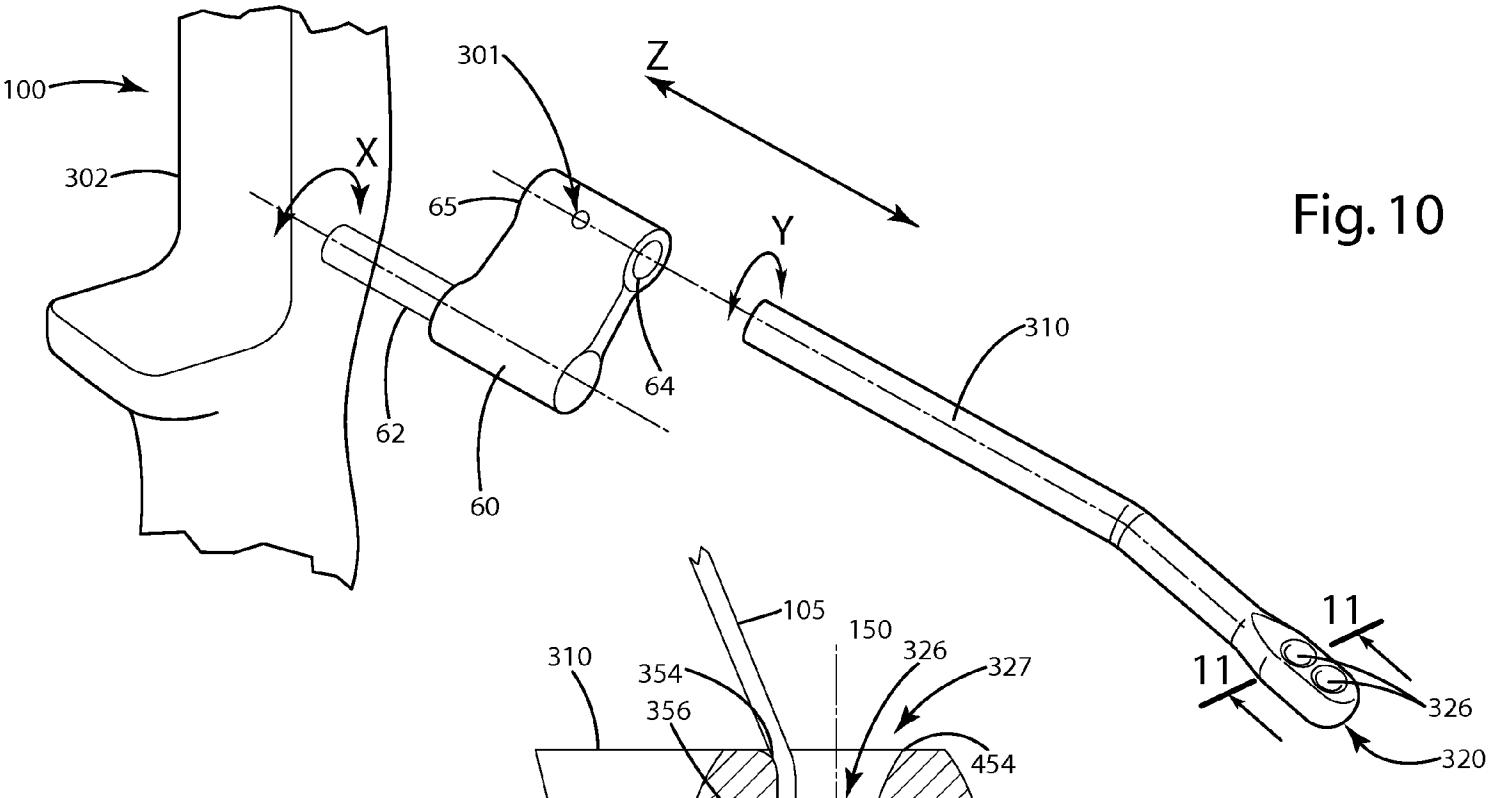
FIG. 10 is a perspective view of a third alternative embodiment of the cable guard including a mounting bracket.
Figure 11:
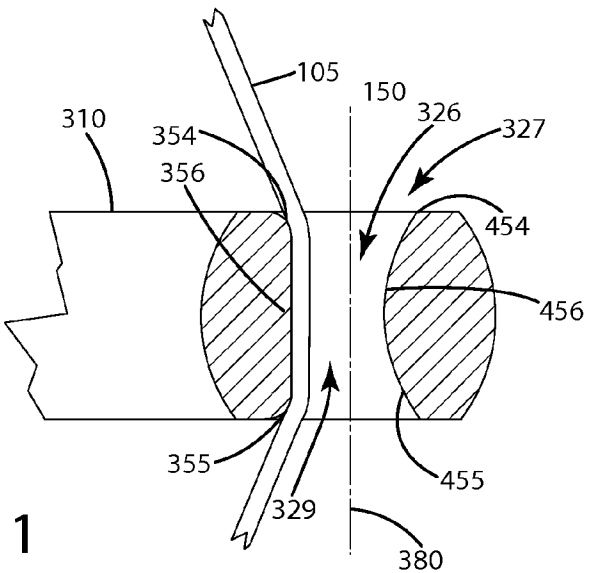
FIG. 11 is a cross sectional view of the third alternative embodiment of the cable guard taken along lines 11-11 of FIG. 10.

A third alternative embodiment of the archery bow 100 including the cable guard 310 and cable guide 320 is shown in FIGS. 10 and 11. In general, this embodiment is similar to the above embodiments with a few exceptions. For example, this embodiment includes a mounting bracket 60. The mounting bracket 60 includes a boss 62 adapted to be inserted into a bore of the bow riser 302. Optionally, the boss can be held in the bore of the riser 302 by threading or a set screw as described above, or other mechanisms. The mounting bracket also includes an offset portion 65 that extends away from the boss. This offset portion can define a bore 64. The axis of this bore 64 can be offset from the axis of the boss 62. The bore 64 can be sized to provide a sliding fit for the riser end of the cable guard 310.

The mounting bracket can enable the cable guard 310 to be moved within the bore 64 in the directions shown by the arrow Z, toward and away from the riser 302. The cable guard 310 can also rotate in the directions shown by arrow Yin the bore 64. In addition, the boss 62 can rotate relative to the riser 302 and/or the bracket 60 in the directions shown by arrow X. The offset of the two axes of the bracket 60 provides rotation in two planes, as illustrated by arrows X and Y. The bracket can be outfitted with a setscrew 301 that engages the cable guard 310 to hold the cable guard 310 in a fixed position relative to the mounting bracket 60.

As shown in FIG. 11, the cable guard 310 can include an integral cable guide 320 which generally includes one or more highly polished bores 326 defined in the base material of the cable guard 310. The bores 326 can be generally cylindrical and can include an axis 380, which can be generally parallel to the bowstring when the bowstring is in an undrawn state. The bore 326 can include a first opening 327 and a second opposing opening 329. The first opening can include a first rounded or radiused edge or surface 354 adjacent the first opening. The second opening can also include a second rounded surface and/or edge 355. Cables 105 or 104 can be positioned through the respective bores. As with the embodiments above, the cable guard and integral guides can engage the cables to hold them out away from the bowstring plane.

In this embodiment, there is no separate insert or cable guide. Instead, the interior surfaces of the bores 326, which can be constructed from metal and/or composites, can be highly polished to prevent abrasion and/or wear. Alternatively, the interior surfaces of the bores 326 can be plated with a metal (for example, chrome, zinc, copper, and/or nickel), alloy or other composition having a low coefficient of friction when engaged with the cable(s). Like the above embodiments, the cable guard 310, bore openings and rounded surfaces are generally immoveable, and remain generally stationary relative to the riser when the bowstring is drawn to the drawn state, and when the bowstring is released.

FIG. 11 also illustrates an example of an alternative transition from the upper edge 454 to the lower edge 455 of the bore 326. For example to the right of FIG. 11, on the interior of the bore, the middle region 456 of the bore can be generally rounded and transitioned cleanly and in a curvilinear manner to the rounded inner surfaces along the edges 454 and 455.

VI. Fourth Alternative Embodiment

Figure 12:
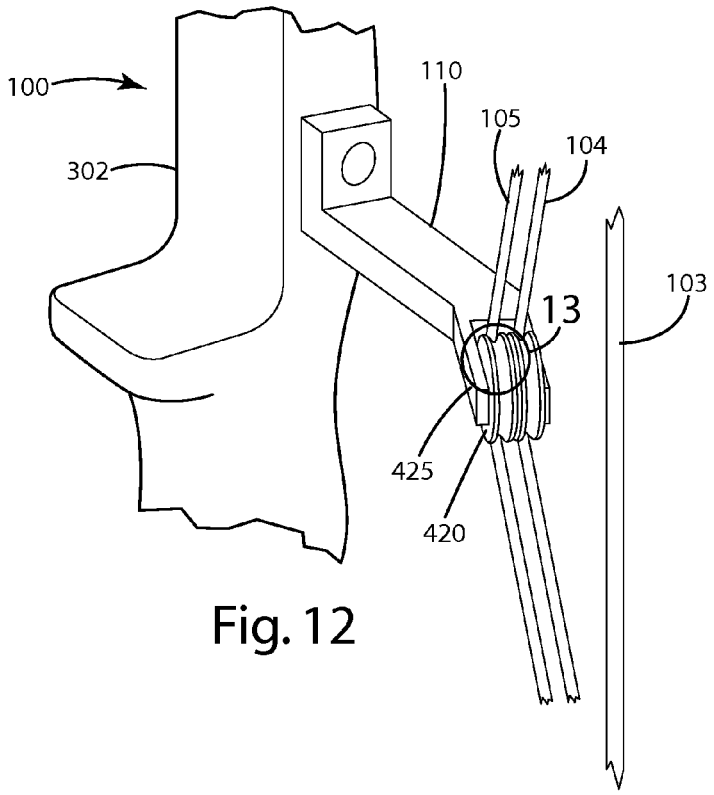
FIG. 12 is a perspective view of a fourth alternative embodiment of the cable guard and cable guides.
Figure 13:
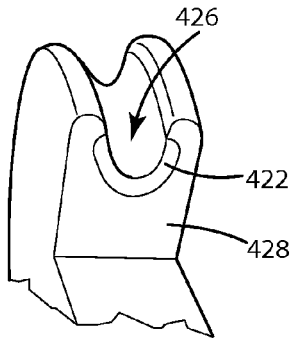
FIG. 13 is an enlarged, sectional view of the cable guide of the fourth alternative embodiment.

FIGS. 12 and 13 illustrate a fourth alternative embodiment of the archery bow including a cable guard 410 and a cable guide 420 which is similar to the above embodiments with a few exceptions. For example, the cable guard 410 extends from the riser 302 and includes a cable guide 420 that is rotatably mounted to the cable guard 410, and that generally move relative to the cable guard 310 as the cables 104 and 105 move. More specifically, the cable guide 420 includes a pulleys 428 that are rotatably mounted to the cable guard 410 with a pulley axle 425.

Each of the pulleys can define a cable guard groove 426 in which the respective cables 104 and 105 can track. Within the groove 426, a ceramic element, or other low friction element 422, is disposed. The ceramic element 422 decreases the amount of friction and wear to the cables riding in the groove 426. A similar cable guard construction utilizing pulleys is illustrated in U.S. Pat. No. 6,722,354 to Land, which is hereby incorporated by reference. The cable guard and cable guides described herein are also well suited for a variety of other movable cable guard and cable guide elements such as that described in the fifth alternative embodiment below.

VII. Fifth Alternative Embodiment

Figure 14:
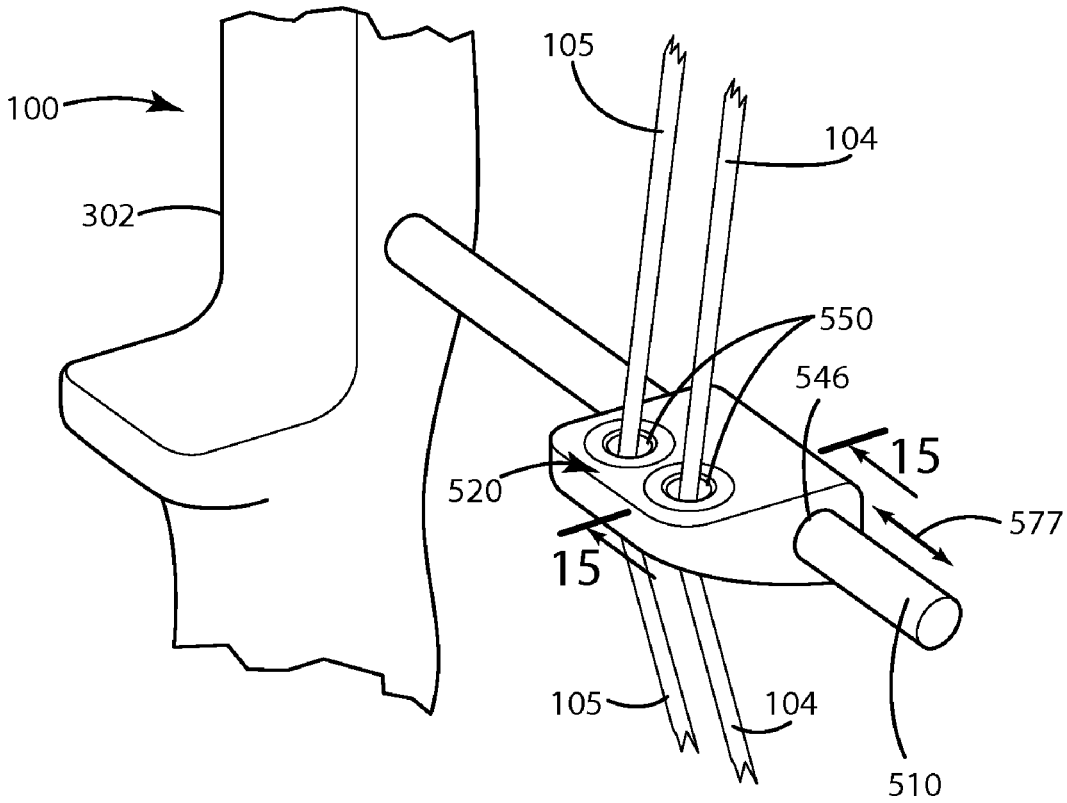
FIG. 14 is a perspective view of a fifth alternative embodiment of the cable guard and cable guides.
Figure 15:
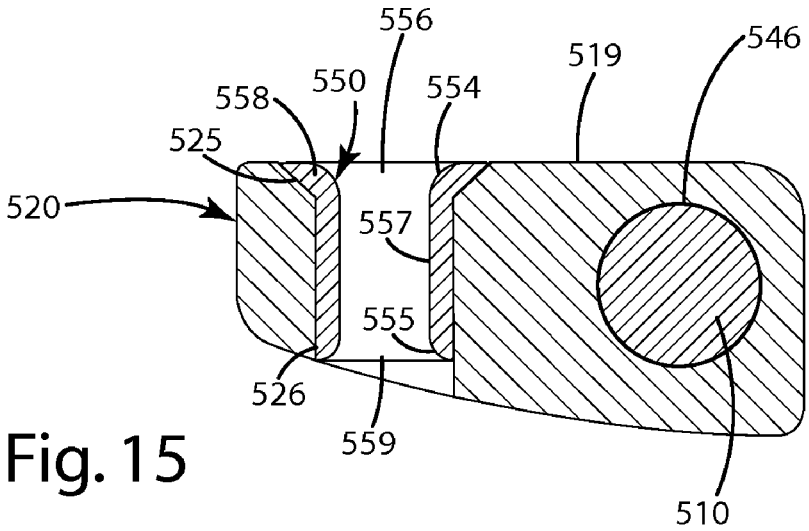
FIG. 15 is a cross sectional view of the fifth alternative embodiment of the cable guides taken along lines 15-15 of FIG. 14.

FIGS. 14 and 15 illustrate a fifth alternative embodiment of the archery bow including a cable guard 510 and cable guide 520, which is similar to the above embodiments with a few exceptions. For example, the cable guide 520 can be movable relative to the cable guard 510. Specifically, the cable guide 520 can slide along the cable guard 510 in the directions of the arrow 577. This movement can be effected as the up and down cables 105 and 104 move when the bowstring is drawn.

As shown in FIGS. 14 and 15, the cable guide 520 can define a bore 526 in which an insert 550 is positioned. The insert 550 can be constructed from a low friction material, as described in any of the above embodiments. The bore 526 can be chamfered in the region 525. Optionally, as desired, this chamfer can be deleted from this construction. The insert 550 can include a shoulder 558 that interfits with the chamfered region 525. The shoulder 558 can also include a rounded or radius inner surface 554 immediately adjacent the opening 556 of the bore 526. The radiused inner surface 554 can transition to a relatively flat middle region 557. If desired, however, the middle region 557 can be curvilinear such as that illustrated in FIG. 11 in the embodiment described above. The middle region 557 can transition to another second rounded or radiused inner surface 555 toward the lower exit opening of the insert 550 in the cable guide bore 526. Although not shown, this lower rounded inner surface 555 can be eliminated so that the lower opening 559 of the insert 550 is perfectly cylindrical.

Further, although not shown, the insert 550 can be substituted with an insert similar to that shown in FIG. 5 so that the shoulder of the insert 550 extends above or otherwise projects above the upper surface 519 of the cable guide 520. Furthermore, although the cable guide 520 in FIG. 15 is shown with a separate insert 550, that insert 550 can be integral with the remainder of the cable guide.

The cable guide 520 can further define a second bore 546 that extends generally perpendicular to the cable guide or cable guard bore 526 an offset a distance therefrom. This second bore 546 can be sized and dimensioned to accommodate the cable guard 510, which is shown of a circular cross section. Of course, this cross section can vary, for example, it can be polygonal, elliptical or of a variety of other geometric shapes. In general, the second bore 546 can be sized to provide a slip fit between the cable guard 510 and the bore so that the cable guide 520 can slide relative to the cable guard 510. Optionally, the cable guide 520 can be outfitted with a bearing surface, or a low friction polymer (not shown) on the inside of the secondary bore 546 to facilitate sliding of the cable guide 520 relative to the cable guard 510.

The cable guide 520 can be constructed of a variety of materials, such as metals, for example, aluminum or magnesium, composites, Teflon, or a variety of other polymers and the like. The insert 550 can be constructed from a low friction material, such as those described in any of the embodiments above. Optionally, the cable guide 520 can be constructed from a reinforced monolithic ceramic element of single integral piece. In such a configuration, the inserts can be integral with the remainder of the guide 520.

The above descriptions are those of current embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. An archery bow, comprising:

a riser;

an upper limb and a lower limb joined with the riser;

a first cam rotatably joined with at least one of the upper and lower limbs;

a bowstring strung at least partially around the first cam and adapted to travel in a bowstring plane;

a first cable strung at least partially around the first cam;

a cable guard including a riser end and a cable end, the riser end joined with the riser, the cable end defining a cable guard bore, the cable guard bore having an upwardly facing opening, the first cable being at least partially positioned through the cable guard bore so that the cable guard bore circumferentiates at least a portion of the first cable; and a cable guide constructed from a low friction material, the cable guide being immovably joined with the cable guard and positioned at a fixed distance from the riser, wherein the low friction material forms a cable guide inner surface including a rounded portion positioned around an uppermost periphery of the upwardly facing opening, the cable guide inner surface engaging the first cable when the cable moves to reduce abrasion of the first cable, wherein the cable guide has no moving parts, wherein the cable guide engages the first cable so that the first cable moves outside the bowstring plane.

2. The archery bow of claim 1 wherein the low friction material is at least one of a ceramic material, a composite and a polymer.

3. The archery bow of claim 2 wherein the low friction material is a ceramic material.

4. The archery bow of claim 1 wherein the cable guide includes a cylindrical portion and a flange, wherein the cylindrical portion is positioned within the cable guard bore and extends from the rounded portion downward toward a lower surface of the cable guard.

5. The archery bow of claim 4 wherein the cable guard includes an edge forming a periphery around at least a portion of the cable guard bore, wherein the flange of the cable guide is positioned adjacent the edge to prevent the cable from engaging the edge.

6. The archery bow of claim 1 wherein the cable guide is in the form of a ceramic insert positioned within the cable guard bore, the cable guide inner surface forming an insert bore that is concentrically positioned within the cable guard bore.

7. The archery bow of claim 1 comprising a second cable adjacent the first cable, wherein the cable guard includes a second cable guard bore and a second cable guide positioned at least partially within the second cable guard bore, wherein the second cable is at least partially positioned through the second cable guard bore so that the second cable guard bore completely circumferentiates the second cable.

8. The archery bow of claim 1 wherein the cable guide inner surface includes a middle region that transitions to the rounded portion, the middle region being at least one of flat and rounded, wherein the rounded portion and middle region are attached in a stationary and unmoving manner relative to the cable guard.

9. An archery bow, comprising:

a riser having an upper limb and a lower limb joined thereto;

a cam rotatably joined with at least one of the upper and lower limbs;

a bowstring strung at least partially around the first cam and adapted to travel in a bowstring plane;

a cable strung at least partially around the first cam;

a cable guard extending from the riser; and a cable guide joined with the cable guard, the cable guide including an upper surface and a lower surface, and defining an aperture, the cable guide engaging the cable so that the cable moves outside the bowstring plane, wherein the cable is strung through and slides relative to the cable guide in a direction leading from the upper surface to the lower surface when the cable moves, wherein the cable guide has no moving parts, wherein the cable guide is immovably joined with the cable guard.

10. The archery bow of claim 9 wherein the cable guard defines a cable guard bore in which the cable guide is positioned, the cable guard bore being parallel to the bowstring when the bowstring is in an undrawn state.

11. The archery bow of claim 9 wherein the cable guide includes a ceramic element having a rounded surface that engages the cable, wherein the ceramic element remains stationary relative to the riser as the cable moves against the ceramic element when the bow is drawn.

12. The archery bow of claim 9 wherein the cable guide includes a ceramic element, the ceramic element including an inner surface that transitions to a rounded edge that completely surrounds the cable strung through the cable guide.

13. The archery bow of claim 9 wherein the cable guide includes an inner surface, wherein the cable slides relative to the inner surface when the cable moves as the bow is drawn, wherein the inner surface transitions to a rounded edge that further transitions directly to the upper surface of the cable guide, wherein the rounded edge completely surrounds the cable strung through the cable guide.

14. The archery bow of claim 9 wherein the cable guard defines a cable guard bore, wherein the cable guide is in the form of a ceramic insert positioned at least partially within the cable guide bore.

15. The archery bow of claim 9 wherein the cable guide includes a ceramic element that engages the cable as the cable slides over the ceramic element.

16. The archery bow of claim 9 wherein the cable guide includes an upper rounded edge that fully surrounds the cable strung through the cable guide.

17. An archery bow comprising:

a riser having an upper limb and a lower limb joined thereto;

a cam rotatably joined with at least one of the upper and lower limbs;

a bowstring strung at least partially around the first cam and adapted to travel in a bowstring plane;

a cable strung at least partially around the first cam;

a cable guard extending from the riser, the cable guard including an upper portion and a lower portion, the upper portion having an upper surface, the cable guard defining a cable guard bore extending through the cable guard from the upper portion to the lower portion, the cable guard bore including an axis, the axis being generally parallel to the bowstring when the bowstring is in an undrawn state, the cable guard bore including a first opening defined by the upper portion, the first opening including a first radiused edge that transitions to the upper surface of the cable guard, the first radiused edge forming a rounded opening around the axis adjacent the upper surface, wherein the cable is positioned through the cable guard bore, wherein the cable guard engages the cable to hold it away from the bowstring plane, wherein the first radiused edge and rounded opening are stationary and immovable relative to the cable guard bore, wherein the cable guard bore includes no moving parts.

18. The archery bow of claim 17 wherein the first radiused edge of the cable guard bore completely circumferentiates the cable positioned therethrough.

19. The archery bow of claim 17 wherein the cable guard bore is in a cylindrical shape.

20. An archery bow, comprising:

a riser joined with upper and lower limbs;

a bowstring joined with the upper and lower limbs and adapted to travel in a bowstring plane;

a cable joined with the upper and lower limbs;

a cable guard joined with at least one of the riser and the upper and lower limbs; and a cable guide joined with the cable guard, the cable guide engaging the cable so that the cable moves outside the bowstring plane, the cable guide including a ceramic element terminating at an edge, the edge being rounded to reduce abrasion to the cable, wherein the cable guide includes no moving parts and is non-rotatably joined with the cable guard.

* * * * *